United States Patent [19]

Szücs et al.

[11] Patent Number: 4,858,685

[45] Date of Patent: Aug. 22, 1989

[54] PLATE-TYPE HEAT EXCHANGER

[75] Inventors: László Szücs; András Harmatha, both of Budapest, Hungary

[73] Assignee: Energigazdalkodasi Intezet, Budapest, Hungary

[21] Appl. No.: 201,366

[22] Filed: May 31, 1988

Related U.S. Application Data

[63] Continuation of Ser. No. 446,972, Dec. 6, 1982, abandoned.

[51] Int. Cl.[4] ..... F28F 3/08

[52] U.S. Cl. ..... 165/166; 165/905; 165/906

[58] Field of Search ..... 165/166, 905, 906

[56] References Cited

U.S. PATENT DOCUMENTS

| | | | |
|---|---|---|---|
| 3,454,082 | 7/1969 | Harke | 165/166 |
| 4,099,928 | 7/1978 | Norback | 165/166 X |
| 4,263,967 | 4/1981 | McNab et al. | 165/166 |
| 4,308,915 | 1/1982 | Sanders et al. | 165/166 |
| 4,348,604 | 9/1982 | Thode | 165/166 X |

FOREIGN PATENT DOCUMENTS

| | | | |
|---|---|---|---|
| 18823 | 11/1980 | European Pat. Off. | 165/166 |
| 434787 | 3/1927 | Fed. Rep. of Germany . | |
| 2226056 | 12/1973 | Fed. Rep. of Germany . | |
| 2332047 | 1/1975 | Fed. Rep. of Germany . | |
| 2706003 | 8/1977 | Fed. Rep. of Germany . | |
| 2634476 | 2/1978 | Fed. Rep. of Germany . | |
| 998449 | 1/1952 | France . | |
| 56-12995 | 2/1981 | Japan | 165/166 |
| 2028996 | 3/1980 | United Kingdom . | |
| 2063450 | 6/1981 | United Kingdom | 165/166 |

*Primary Examiner*—Albert W. Davis, Jr.
*Attorney, Agent, or Firm*—Klein & Vibber

[57] ABSTRACT

A heat exchanger has a plurality of like plates each in turn provided with a base portion substantially on and defining a base plane and having a pair of generally parallel opposite outer edges, and respective lips bent upward from the outer edges and forming and lying on an attachment plane substantially parallel to the base plane. Adhesive bonds or welds secure the plates together in a stack to form generally perpendicular flow passages parallel to the plane. The lips of each plate extend generally perpendicular to the lips of the adjacent plate and the plates are secured together with the connection plane of each plate lying on the base plane of an adjacent plate. Each plate is formed between the respective opposite edges with a plurality of integral bumps projecting from the respective base plane toward the respective connection plane. These bumps each have an apex lying on the respective connection plane. Thus the base or center portion of each plate presses with the tops of its bumps against the bottom face of the base portion of the overlying plate and its bottom face lying on top of the bumps of the underlying plate.

12 Claims, 3 Drawing Sheets

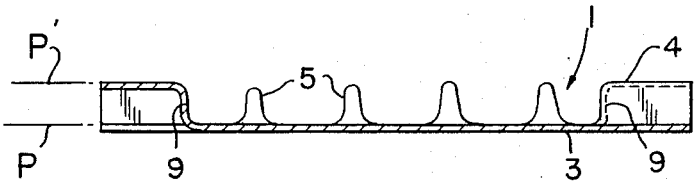
FIG. 4
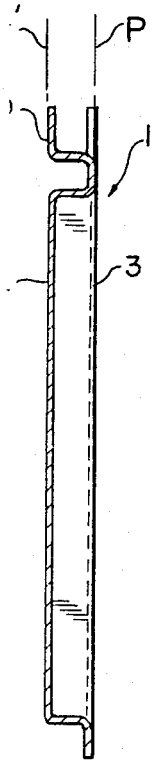
FIG. 6
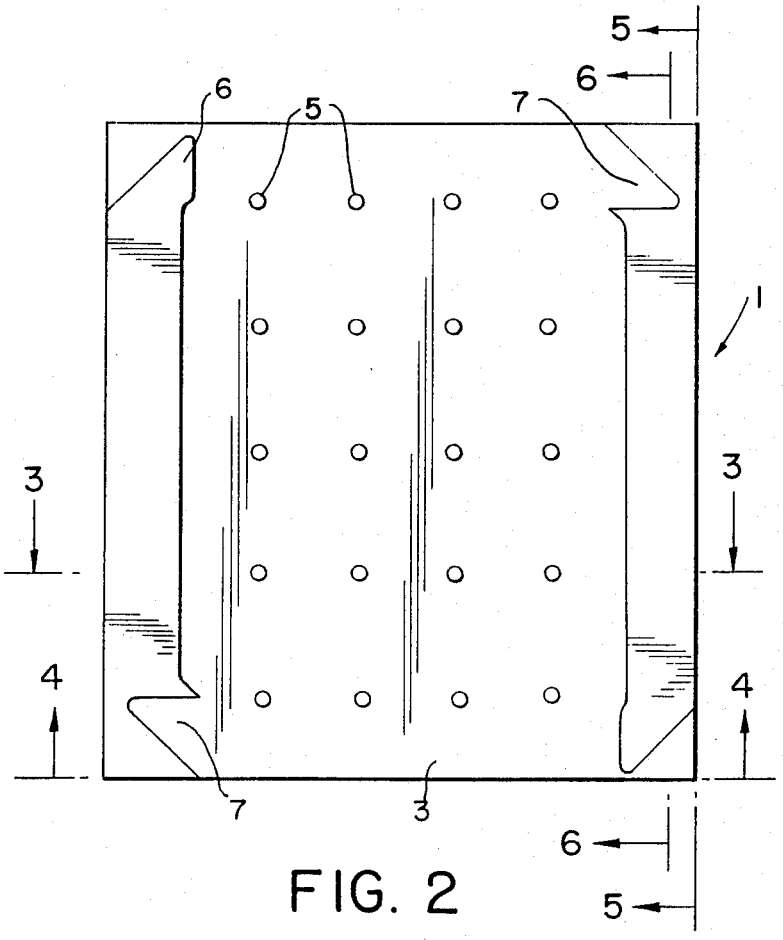
FIG. 2
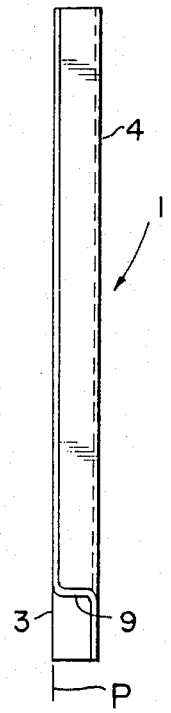
FIG. 5
FIG. 3
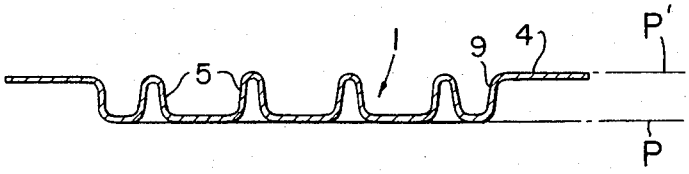

PLATE-TYPE HEAT EXCHANGER

This application is a continuation of Ser. No. 446,972, filed Dec. 6, 1982 abandoned.

FIELD OF THE INVENTION

The present invention relates to a heat exchanger. More particularly this invention concerns a plate-type heat exchanger.

BACKGROUND OF THE INVENTION

A plate-type heat exchanger for heat exchange between two fluids is formed of a stack of plates shaped to form two independent sets of normally transverse passages through which respective fluids can be passed. The plates are thermally conductive so the warmer fluid can heat the cooler one.

The basic type of such a heat exchanger is described in German patent publication No. 2,226,056, where the exchanger is intended for use principally as a condenser in a household clothes dryer. It has a stack of thin metal plates separated by rigid rails to which these plates are bonded to form a set of coolant passages and an independent set of moist-air passages. The entire assembly is held in a frame that may form the separating rails, or each plate may be held in its own frame.

Another standard heat exchanger of the plate type is seen in U.S. Pat No. 3,454,082. Here two passages are formed between a plurality of identical plates, with every other plate extending at a right angle to the two plates sandwiching it. These plates are metallic and the exchanger is intended for use with liquids.

Variations on these styles abound. German patent document No. 2,706,003 has three-part plates with throughgoing holes. British patent No. 2,028,996 describes a system provided with special seals between the plates. In German patent publication No. 2,634,476 a stack of adjacent profiles is used. German patent publication No. 2,332,047 has hollow plates formed with ribs for use in a boiler. In French patent No. 998,449 the plates form inclined flow passages, while German patent No. 434,787 has so-called zigzag passages.

The problems of these known systems have three principal sources: the material of the plates, the rigidity of the entire assembly, and the connection and sealing between the plates and the surrounding frame.

The material of the plates is usually metal. As such the plates are usually strong and highly thermally conductive. Nonetheless unless expensive alloys are used, the plates are subject to corrosion and therefore have a short service life. Furthermore appropriately shaping the metal plates can be quite difficult, especially when an extremely tough alloy is employed.

A corrosion-resistant synthetic resin can easily be given any desired shape. Nonetheless it is necessary to make the plates relatively thick to obtain the necessary rigidity, and since most resins are poor conductors of heat, such thick plates greatly reduce exchanger efficiency. In addition the sealing and mounting problems of the metal plates are not overcome in the synthetic-resin plates.

OBJECTS OF THE INVENTION

It is therefore an object of the present invention to provide an improved plate-type heat exchanger.

Another object is the provision of such a plate-type heat exchanger which overcomes the above-given disadvantages.

A further object is to provide this type of heat exchanger which can be produced at low cost.

SUMMARY OF THE INVENTION

These objects are attained according to the instant invention in a heat exchanger having a plurality of like plates each in turn having a base portion substantially on and defining a base plane and having a pair of generally parallel opposite outer edges, and respective lips bent upward from the outer edges and forming and lying on an attachment plane substantially parallel to the base plane. Appropriate means, such as adhesive bonds or welds, secure the plates together in a stack to form generally perpendicular flow passages parallel to the planes. The lips of each plate extend generally perpendicular to the lips of the adjacent plate and the plates are secured together with the connection plane of each plate lying on the base plane of an adjacent plate. The connection bonds normally extend substantially the full length of each lip.

Such plates are therefore continuous within their outer edges so that adjacent passages are perfectly separated from each other. The lips take the place of a separate frame so as to reduce the possibility of leakage at this element as well as production costs.

According to this invention the heat exchanger is made particularly rigid by forming each plate between the respective opposite edges with a plurality of integral bumps projecting from the respective base plane toward the respective connection plane. These bumps each have an apex lying on the respective connection plane. Thus the base or center portion of each plate presses with the tops of its bumps against the bottom face of the base portion of the overlying plate and its bottom face lies on top of the bumps of the underlying plate. The array of bumps is offset slightly from a perfectly centered position so the bumps are staggered from plate to plate.

These plates of this invention can be of a thin and rigid synthetic resin, such as polyvinyl (PVC). Due to the three-dimensional shape of each plate as well as the way the plates interfit and lie against one another, it is possible to use a relatively small wall thickness and still produce a very robust stack. Such a thin plate therefore can be quite conductive.

According to another feature of this invention the lips each have an end forming a reinforcement. In addition, the plates are diagonally symmetrical. More particularly the plates each have two generally parallel second outer edges bridging and generally perpendicular to the respective first-mentioned outer edges and bonded to the lips of the underlying plate. Each lip has one end spaced along the respective first edge from one of the respective second edges and having an end formation extending along the respective second edge and an opposite end at the other second edge and having a side formation extending along the respective first edge. The side and end formations of the lips of each plate respectively underlie, in a direction perpendicular to the planes, the end and side formations of the overlying plate whose base plane it engages, it being understood that the terms "overlie" and "underlie" only have a relative meaning and have no absolute meaning in this context. This construction can be very robust, particularly resistant to crushing in the critical corner regions in a direction perpendicular to the planes. Thus the entire stack can be clamped tight at these corners to eliminate the possibility of leakage here.

The corners can further be reinforced by the provision of respective fittings secured to the overlying corners and extending generally perpendicular to the planes. When the fittings are of T-section it is possible to fit together a plurality of stacks with their planes coinciding or parallel,to form any possible size of heat exchanger. Sealing the fittings against each other can be fairly sure and very tight.

Each of the lips has an outer portion lying on and defining the respective connection plane and an inner web connected between the inner edge of the respective outer portion and the outer edge of the respective base portion. Thus the plate is not of double thickness at any region, that is the lips do not double back over the plate. The plates are bendable in their central regions between the lips, but the lips are three-dimensional so they are somewhat more rigid, preventing bending altogether about axes transverse to the lips. Since each plate lies on and is fastened to the transverse lips of the underlying plate, or on a flat end plate, deformation in this direction is similarly impossible, and the assembly has its requisite stability.

DESCRIPTION OF THE DRAWING

The above and other features and advantages will become more readily apparent from the following, reference being made to the accompanying drawing in which:

FIG. 2 is a top view of a plate of the exchanger of the invention;

FIG. 3 is a section taken along line 3—3 of FIG. 2;

FIGS. 4 and 5 are views taken in the direction of respective arrows 4 and 5 of FIG. 2;

FIG. 6 is a section taken along line 6—6 of FIG. 2; and

SPECIFIC DESCRIPTION

Figure 1:
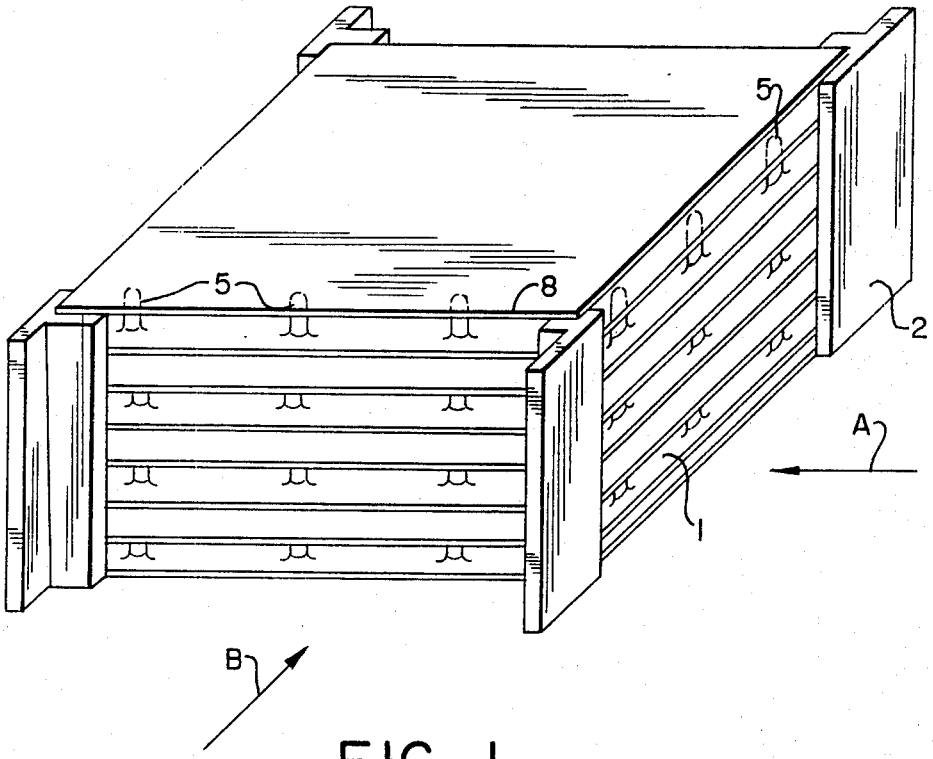
FIG. 1 is a perspective view of the heat exchanger according to this invention.
Figure 7:
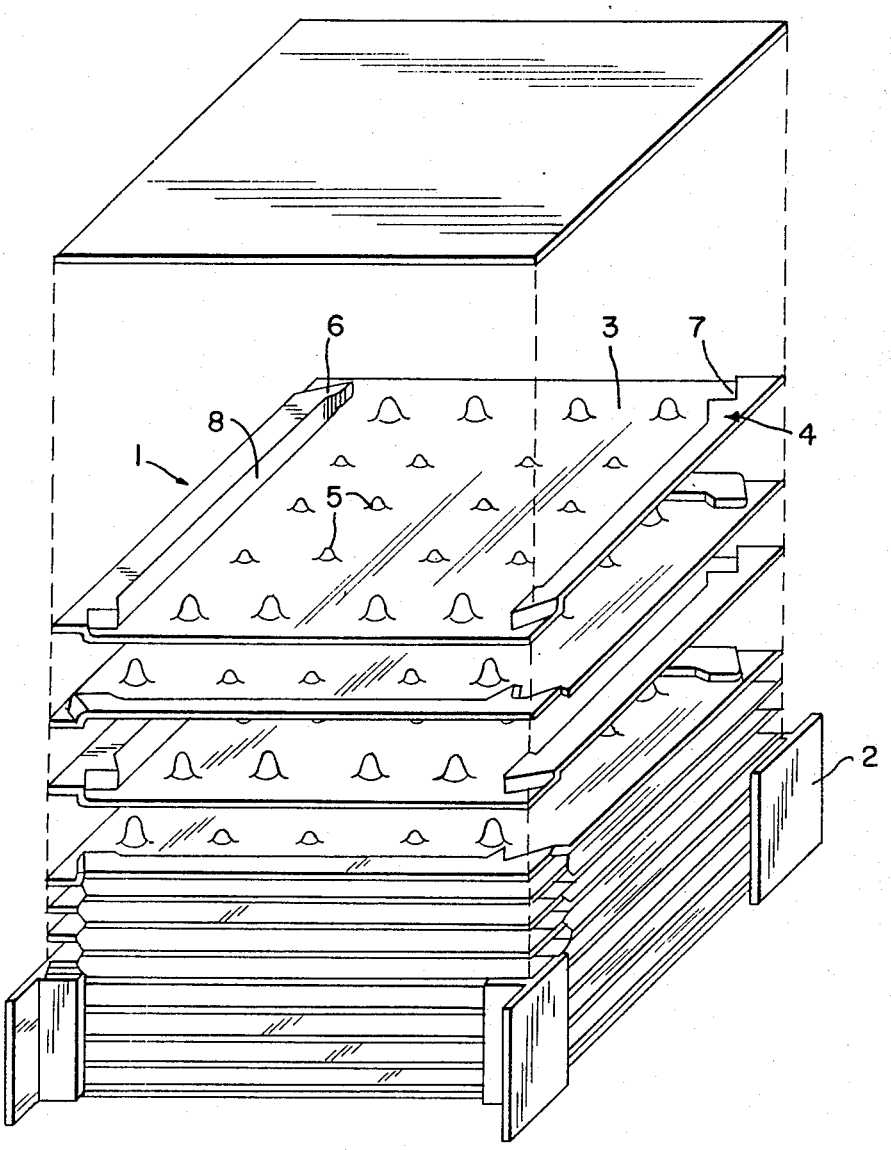
FIG. 7 is a partially exploded view in perspective of the plate assembly shown in FIG. 1.

As seen in FIGS. 1 and 7 a heat exchanger is made of a stack of identical square plates 1 and 1' defining a plurality of interleaved but orthogonal passages A and B. T-section holders 2 are cast at the corner of the stack of plates 1, 1' which are held together at weld or adhesive bonds 8 where they touch. Units such as shown in FIGS. 1 and 7 can be stacked on top of one another or next to one another to make a heat exchanger of any size, enlarging it parallel to the passages A and/or the passages B and/or perpendicular thereto.

It is to be noted that the top plate 1*a* shown in FIGS. 1 and 7 is a plane plate, without the spacers or bumps 5, described below. It is also to be noted that plates 1 and 1' alternate in the stack, that the main extents of such plates are parallel, that plates 1 and 1' are of identical structure, and that plates 1' are disposed similarly but turned 90° with respect to the plates 1.

FIGS. 2–6 show one of the plates 1 in more detail. It has a central part 3 lying on and defining a base plane P and a pair of identical L-section upturned lips 4 on opposite edges defining a connection plane P' parallel to and slightly offset from the plane P. As best seen from FIGS. 3 and 6, these lips 4 are bent up from the section 3, being connected thereto at their inner edges by webs 9 perpendicular to both planes P and P'. Thus the passages A and B are perfectly separated from each other, as within their square-defining outer edges the plates 1 are all wholly imperforate.

Between the lips 4 the section 3 is formed with a regular array of generally cylindrical bumps 5 each having an apex or top lying exactly on the plane P'. Thus each plate 1 is supported on the overlying plate 1 at the section 3 by the bumps 5, and at the outer edges by the lips 4. Thus it is possible to use a relatively thin, and hence highly conductive, synthetic resin such as polyvinyl chloride for the plates 1. Such a resin can relatively easily be formed into the illustrated shape and due to its thinness will conduct heat between the adjacent passages A and B quite well. Even a relatively thin foil can, in the illustrated construction, be made into a relatively rigid heat-exchanger unit such as shown in FIG. 1, especially in a unit having a close plate spacing, which therefore will have an enormous effective heat-exchange surface area per unit of volume. Furthermore PVC is largely corrosion resistant and quite cheap.

The corners of the plates 1 are formed for providing a more secure sealing between adjacent plates 1. The so formed corners are diagonally symmetrical. In two diagonally symmetrical corners, attachment plane 4 is made to be wider by providing a projection 6 in this plane 4. In both corners adjacent to this first corners, attachment plane 4 is made to be narrower by providing a narrowing 7 in these diagonally opposite corners. Here, the base plane 3 is made to be greater. Of course, the continuity of the material of plate 1 is maintained at the corners, too. The shapes of projections 6 and narrowings correspond to each other. Since superimposed plates 1 are laid on each other 90? offset to each other, the enlarged surface areas of base plane 3 at narrowings 7 lie on the enlarged surface areas of attachment plane 4 at projections 6. With this, the contact surfaces between superimposed plates 1 are enlarged and tightening capability is made greater just in the critical corner areas. With this, the leakage occurring at the corners of the known sections can be prevented without the use of any corner elements. T-section holders 2 serve only stiffening and interconnection purposes.

What is claimed is:

1. A heat exchanger in the form of a stack of plates, comprising:

a plurality of diagonally symmetrical like parallel plates, alternate plates being disposed at 90 degrees with respect to adjoining plates, each of the plates having a base portion substantially on and defining a base plane;

each of the plates having a pair of generally parallel opposite first outer edges and two generally parallel second outer edges bridging and generally perpendicular to the respective first outer edges;

respective lips bend upward from the base plane along said first outer edges and forming and lying on a connection plane substantially parallel to the base plane;

each lip having a first end formation defining a portion of said base plane spaced in from said first outer edge and adjacent one of said second outer edges, and having an opposite second end formation defining a portion of said base plane adjacent both said first outer edge and the other of said second outer edges, said end formations being arranged in directions opposite each other whereby each of said outer edges has a portion lying in said base plane and a portion lying in said connection plane;

whereby when said plates are stacked 90 degrees with respect to one another, said connection plane of one plate underlies said base plane of an adjacent plate such that the first outer edges of said one plate underlie the second outer edges of said adjacent plate and the connection plane of said one plate is in full contact with an edge portion of the base plane of said adjacent plate, said second end formations of said one plate underlying said first end formations of said adjacent plate;

means for securing the plates together in a stack to form respective sets of flow passages sealed from each other, and parallel to the planes, the sets of flow passages being disposed generally perpendicularly to each other.

2. The heat exchanger defined in claim 1 wherein the lips of each plate extend generally perpendicular to the lips of the adjacent plate, the means securing the plates together with the connection plane of each plate lying on the base plane of an adjacent plate.

3. The heat exchanger defined in claim 2 wherein each plate is further formed between the respective opposite edges with a plurality of integral bumps projecting from the respective base plane toward the respective connection plane.

4. The heat exchanger defined in claim 3 wherein the bumps each have an apex lying on the respective connection plane.

5. The heat exchanger defined i claim 2 wherein the plate is of a thin and rigid synthetic resin.

6. The heat exchanger defined in claim 5 wherein the resin is polyvinyl chloride.

7. The heat exchanger defined in claim 1 wherein the lips each have an end forming a reinforcement.

8. The heat exchanger defined in claim 1 wherein the means for securing includes adhesive bonds.

9. The heat exchanger defined in claim 1 wherein the means for securing includes welds.

10. The heat exchanger defined in claim 1 wherein the plates have overlying corners, the heat exchanger further including respective fittings secured to the overlying corners and extending generally perpendicular to the planes.

11. The heat exchanger defined in claim 10 wherein the fittings are of T-section.

12. The heat exchanger defined in claim 1 wherein each of the lips has an outer portion lying on and defining the respective connection plane and an inner web connected between the inner edge of the respective outer portion and the outer edge of the respective base plane.

* * * * *